US011078438B2

(12) United States Patent
Patel et al.

(10) Patent No.: US 11,078,438 B2
(45) Date of Patent: Aug. 3, 2021

(54) EXTREME PRESSURE METAL SULFONATE GREASE

(71) Applicant: Chemtool, Incorporated, Rockton, IL (US)

(72) Inventors: Thakorbhai S. Patel, Rockton, IL (US); Jeffrey D St. Aubin, Rockton, IL (US)

(73) Assignee: Chemtool Incorporated, Rockton, IL (US)

( * ) Notice: Subject to any disclaimer, the term of this patent is extended or adjusted under 35 U.S.C. 154(b) by 0 days.

(21) Appl. No.: 16/751,712

(22) PCT Filed: Jul. 24, 2018

(86) PCT No.: PCT/US2018/043467

§ 371 (c)(1),
(2) Date: Jan. 24, 2020

(87) PCT Pub. No.: WO2019/023219

PCT Pub. Date: Jan. 31, 2019

(65) Prior Publication Data

US 2020/0270543 A1 Aug. 27, 2020

Related U.S. Application Data

(60) Provisional application No. 62/536,172, filed on Jul. 24, 2017.

(51) Int. Cl.

| | |
|---|---|
| ***C10M 145/36*** | (2006.01) |
| ***C10M 159/24*** | (2006.01) |
| ***C10M 159/20*** | (2006.01) |
| ***C10N 30/04*** | (2006.01) |
| ***C10N 30/06*** | (2006.01) |
| ***C10N 30/12*** | (2006.01) |
| ***C10N 50/10*** | (2006.01) |
| ***C10N 30/00*** | (2006.01) |
| ***C10N 40/02*** | (2006.01) |
| ***C10N 40/04*** | (2006.01) |

(52) U.S. Cl.

CPC ..... *C10M 145/36* (2013.01); *C10M 159/20* (2013.01); *C10M 159/24* (2013.01); *C10M 2203/024* (2013.01); *C10M 2203/0206* (2013.01); *C10M 2203/1065* (2013.01); *C10M 2205/0285* (2013.01); *C10M 2205/163* (2013.01); *C10M 2207/028* (2013.01); *C10M 2209/104* (2013.01); *C10M 2209/1033* (2013.01); *C10M 2219/046* (2013.01); *C10M 2229/025* (2013.01); *C10N 2030/04* (2013.01); *C10N 2030/06* (2013.01); *C10N 2030/12* (2013.01); *C10N 2030/52* (2020.05); *C10N 2040/02* (2013.01); *C10N 2040/04* (2013.01); *C10N 2050/10* (2013.01)

(58) Field of Classification Search

CPC ..... C10M 145/26; C10M 159/20; C10M 159/24; C10M 2203/0206; C10M 2203/24; C10M 2203/1065; C10M 2205/0285; C10M 2205/163; C10M 2207/028; C10M 2209/1033; C10M 2209/104; C10M 2219/046; C10M 2229/025; C10N 2030/04; C10N 2030/06; C10N 2030/12; C10N 2030/52; C10N 2040/02; C10N 2040/04; C10N 2050/10

See application file for complete search history.

(56) References Cited

U.S. PATENT DOCUMENTS

| | | | | |
|---|---|---|---|---|
| 8,563,488 | B2 * | 10/2013 | Sivik | C10M 123/06 508/460 |
| 2004/0235679 | A1 * | 11/2004 | Kurosky | C10M 169/00 508/174 |
| 2010/0107004 | A1 * | 4/2010 | Bottelli | G11C 29/802 714/6.12 |
| 2016/0230112 | A1 | 8/2016 | Waynick | |

FOREIGN PATENT DOCUMENTS

| | | | |
|---|---|---|---|
| EP | 0586258 | B1 | 11/2001 |
| WO | 2004106474 | A1 | 12/2004 |
| WO | 2009042507 | A1 | 4/2009 |

OTHER PUBLICATIONS

PCT Written Opinion of the International Searching Authority, dated Dec. 4, 2018.
PCT International Search Report, dated Dec. 4, 2018.
PCT the International Preliminary Report on Patentabiliy, dated Jul. 26, 2019.
PCT International Preliminary Report on Patentability, dated Nov. 4, 2019.
BASF Corporation, Pluronic® L101 Block Copolymer Surfactant, Technial Bulletin, 2002.
C:\EPODATA\sea\eplogf\External.log Chemical Abstract, AN1987:425868 & SU1293206.

* cited by examiner

*Primary Examiner* — James C Goloboy
(74) *Attorney, Agent, or Firm* — Iken Sans; Teresan Gilbert

(57) ABSTRACT

An overbased metal detergent grease comprising at least one of polyalkylene glycol and/or an acid having at least one of both a nitrogen and a sulfur atom. The grease has improved extreme pressure performance as measured by the Standard Test Method for Measurement of Extreme-Pressure Properties of Lubricating Grease (Four-Ball Method), ASTM D2596.

Methods of making an overbased metal detergent grease comprising using at least one of polyalkylene glycol and/or an acid having at least one of both a nitrogen and a sulfur atom. Methods of lubricating mechanical components using the grease comprising contacting the mechanical component with the grease. Mechanical components can include gears, drivetrain elements, bearings, hinges, or combinations thereof.

19 Claims, No Drawings

EXTREME PRESSURE METAL SULFONATE GREASE

CROSS REFERENCE TO RELATED APPLICATION

This application claims priority from PCT Application Serial No. PCT/US2018/043467 filed on Jul. 24, 2018, which claims the benefit of U.S. Provisional Application No. 62/536,172 filed on Jul. 24, 2017.

FIELD OF THE INVENTION

The field of the disclosed technology is generally related to an overbased metal detergent grease comprising at least one polyalkylene glycol, and/or an acid having at least one of both a nitrogen and sulfur atom.

BACKGROUND OF THE INVENTION

Traditionally, high-performance lubricating calcium sulfonate greases are prepared by converting the over-based calcium sulfonate's amorphous particle to a crystalline state, also known as gelation. During the gelation process, calcium carbonate, along with one or more promotors such as water, acids, alcohols, amines, etc. that destabilize the sulfonate's micellular structure, are used to convert the amorphous particle to crystalline particles of calcite or vaterite. The promotors used during the gelation process are also referred to as converting agents. Typical converting agents are used in the range of 1 to 10 weight percent ("wt %"), based on the total yield of the grease.

Greases often have additives, called extreme pressure additives or agents, to prevent or reduce sliding metal surfaces from seizing under severe contact conditions. Traditionally, extreme pressure additives, such as molybdenum disulfide or phosphoric acid have been added to improve the extreme pressure properties of the grease. These extreme pressure additives can be expensive and, in some cases, environmentally unfriendly. These extreme pressure additives may also be detrimental to other desired properties of the grease. For example, phosphoric acid may interfere with anti-corrosion properties of the grease.

SUMMARY OF THE INVENTION

It was surprisingly found that overbased metal detergent greases made using a polyalkylene glycol and/or an acid having at least one of both a nitrogen and a sulfur atom have improved extreme pressure properties without the use of molybdenum disulfide or phosphoric acid or derivatives of the same. Accordingly, an overbased metal detergent grease comprising at least one of polyalkylene glycol and/or an acid having at least one of both a nitrogen and a sulfur atom is disclosed.

In some embodiments, the polyalkylene glycol may have a number average ($M_n$) molecular weight of 190 to 9000, 350 to 1000, or 350 to 750. In another embodiment, the polyalkylene glycol has a number average molecular weight of 350 to 750. In one embodiment, the polyalkylene glycol has at least one polyalkylene group selected from polyethylene (190 to 9000 $M_n$), methoxypolyethylene (350 to 750 $M_n$), or mixtures thereof. In another embodiment, the polyalkylene glycol may be methoxypolyethylene glycol. The polyalkylene glycol may be present in a range of 0.1 to 3, to 0.1 to 2, to 0.1 to 1, to 0.3 to 1.5, or 0.3 to 1.0 or 0.5 to 1.0 weight percent based on a total yield of the grease.

In other embodiments, the acid is present in a range of 0.1 to 3, to 0.1 to 2, to 0.1 to 1, to 0.2 to 0.7 or 0.3 to 0.6 weight percent based on a total yield of the grease. In one embodiment, the acid may be a sulfonic acid having at least one amine and/or amide functional group. In another embodiment, the sulfonic acid may comprise at least one of sulfamic acid, 2-acrylamido 2-methyl propane sulfonic acid, or combinations thereof.

In another embodiment, the grease may comprise the adduct of an acid and a polyalkylene glycol. The weight ratio of the acid to polyalkylene glycol may range from 4:1 to 1:4, 3:1 to 1:3, 2:1 to 1:2, or 1.5:1 to 1:1.5. In yet another embodiment, the adduct may be the adduct of sulfamic acid and methoxypolyethylene glycol.

In some embodiments, the overbased metal detergent may have a total base number of TBN of 150 to 700, or 200 to 600, or 300 to 500. In yet other embodiments, the overbased metal detergent may be an overbased metal sulfonate, salicylate, naphthalene, naphthenate, phenate or oleate detergent, or mixtures thereof. The overbased metal detergent may be present in a range of 15 to 75, or 20 to 60 weight percent based on a total yield of the grease. In yet other embodiments, the grease is a food-grade grease.

In some embodiments, the grease comprises at least one base oil selected from highly refined mineral oils ("liquid paraffin" or "white oil"), polyalphaolefin, polyalkylene glycol, seed oil, vegetable oil ("esters"), or mixtures thereof. In other embodiments, the grease may comprise an oil of lubricating viscosity selected from at least one API Group I, II, III, IV, or V oil, naphthenic oil, silicone oil, esters, or mixtures thereof.

The grease as described in any of the embodiments above, may have an extreme pressure performance, as measured by the Standard Test Method for Measurement of Extreme-Pressure Properties of Lubricating Grease ("Four-Ball Method") ASTM D2596, of passing, or at least 620 kg-f. In yet another embodiment, the weld point using the Four-Ball Method of the grease may be at least 800 kg-f. In some embodiments, the grease may have a copper corrosion value as measured using ASTM D4048 of 1B or better. In other embodiments, the grease may have a wear test result of less than or equal to 0.60 mm using ASTM D2266.

The disclosed grease may be made using a variety of methods. One method may comprise a gelation step and a complexing step, and wherein an acid having at least one of both a nitrogen and a sulfur atom is used in said complexing step.

Methods of lubricating a mechanical component using the grease described above are also disclosed. The method may comprise contacting a mechanical component with a grease. Mechanical components can include gears, drivetrain elements, bearings, hinges, or combinations thereof.

Method of improving the extreme pressure performance of an overbased metal sulfonate grease are also disclosed. The extreme pressure performance can be measured by the Standard Test Method for Measurement of Extreme-Pressure Properties of Lubricating Grease (Four-Ball Method), ASTM D2596.

DETAILED DESCRIPTION OF THE INVENTION

Each of the documents referred to herein is incorporated by reference, including any prior applications, whether or not specifically listed herein, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about". It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

Various features and embodiments will be described below by way of non-limiting descriptions and examples. In one embodiment, an overbased metal detergent grease comprising at least one of polyalkylene glycol and/or an acid having at least one of both a nitrogen and a sulfur atom is disclosed.

The Polyalkylene Glycol

Suitable polyalkylene glycols ("PAGs") are not overly limited and include polyethers terminated with a hydroxyl group. In one embodiment, the PAG can include compounds of formula (I):

(I)

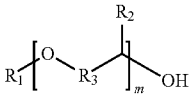

wherein: $R_1$ can be hydrogen (H), —$R_4$OH, or —(C═O)$R_4$ or a hydrocarbyl group of from 1 to 30 carbon atoms; $R_2$ can be H, or a hydrocarbyl group of from 1 to 10 carbon atoms; and $R_3$ can be a straight or branched hydrocarbyl group of from 1 to 6 carbon atoms; $R_4$ can be a hydrocarbyl group of 1 to 20 carbon atoms; and m can be an integer from 1 to 30.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

In other embodiments, $R_1$ can be a hydrocarbyl group of from 1 to 20, or 1 to 10 carbon atoms, and in some embodiments 1 to 6, or 1 to 4, or 1 or 2 carbon atoms. In yet another embodiment, $R_1$ can be H or a methyl group. In other embodiments, $R_2$ can be a hydrocarbyl group of from 1 to 8, or 1 to 6 carbon atoms. In one embodiment, $R_2$ can be H or a methyl group, i.e. a single carbon hydrocarbyl group. In another embodiment, $R_3$ can be a straight or branched hydrocarbyl group of from 1 to 4, or 1 or 2 carbon atoms, or even 1 carbon atom. In another embodiment, $R_3$ can be a methylene group. In another embodiment, $R_4$ can be a hydrocarbyl group of 1 to 10 carbon atoms and in some embodiments 1 to 6, or 1 to 4, or 1 or 2 carbon atoms. It yet another embodiment, $R_4$ can be $CH_2CH(CH_3)$. In other embodiments, m may be an integer from 1 to 20, or 1 to 10, or 1 to 3 or 7.

The polyalkylene glycol may have a number average ($M_n$) molecular weight of 190 to 9000, 350 to 1000, or 350 to 750. In one embodiment, the polyalkylene glycol may have at least one polyalkylene oxide group selected from polyethylene oxide (350 to 9000 Me), methoxypolyethylene oxide (350 to 750 $M_n$), or mixtures thereof. In other embodiments, the polyalkylene glycol is present in a range of 0.1 to 3, to 0.1 to 2, to 0.1 to 1, to 0.3 to 1.5, or 0.3 to 1.0 or 0.5 to 1.0 weight percent based on a total yield of the grease. In yet other embodiments, the polyalkylene glycol may be polyethylene glycol or methoxypolyethylene glycol. Suitable polyalkylene glycols are not overly limited. Commercially available polyalkylene glycols include TPEG-550, TPEG-990, Carbowax Sentry Grade 4000, Carbowax Sentry Grade 8000, MPEG 500 Sentry Grade and Polyglycol P-4000.

The acid may be present in a range of 0.1 to 3, to 0.1 to 2, to 0.1 to 1, to 0.2 to 0.7 or 0.3 to 0.6 weight percent based on a total yield of the grease. In some embodiments, the acid may be sulfamic acid.

In some embodiments, the grease may comprise the adduct of an acid and a polyalkylene glycol. The weight ratio of the acid to polyalkylene glycol may range from 4:1 to 1:4, 3:1 to 1:3, 2:1 to 1:2, or 1.5:1 to 1:1.5. In yet other embodiments, the grease comprises an adduct of sulfamic acid and polyethylene glycol or methoxypolyethylene glycol.

The Acid

The acid used to make the grease has at least one of both a nitrogen and a sulfur atom. Suitable acids are not overly limited and may be a sulfonic acid having at least one amine and/or amide functional group. In another embodiment, the sulfonic acid may comprise at least one of sulfamic acid, 2-acrylamido 2-methyl propane sulfonic acid, or combinations thereof.

The 2-acrylamido 2-methyl propane sulfonic acid may have the structure below.

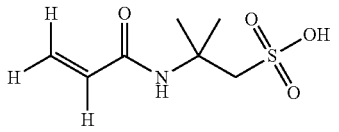

The Overbased Metal Detergent

The grease may be prepared using any overbased metal detergent known in the art. Overbased metal detergents, otherwise referred to as overbased detergents, metal-containing overbased detergents or superbased salts, are characterized by a metal content in excess of that which would be necessary for neutralization according to the stoichiometry of the metal and the particular acidic organic compound, i.e. the substrate, reacted with the metal. The overbased detergent may comprise one or more of non-sulfur containing phenates, sulfur containing phenates, sulfonates, salicylates, and mixtures thereof. Alternatively, the overbased metal detergent may comprise at least one overbased metal sulfonate, salicylate, naphthalene, naphthenate, or oleate detergent, or mixtures thereof.

The amount of excess metal is commonly expressed in terms of substrate to metal ratio. The terminology "metal ratio" is used in the prior art and herein to define the ratio of the total chemical equivalents of the metal in the overbased salt to the chemical equivalents of the metal in the salt which would be expected to result from the reaction between the hydrocarbyl substituted organic acid; the hydrocarbyl-substituted phenol or mixtures thereof to be overbased, and the basic metal compound according to the known chemical reactivity and the stoichiometry of the two reactants. Thus, in a normal or neutral salt (i.e. soap) the metal ratio is one and, in an overbased salt, the metal ratio is greater than one, especially greater than 1.3. The overbased detergent may have a metal ratio of 5 to 30, or a metal ratio of 7 to 22, or a metal ratio of at least 11.

The metal-containing detergent may also include "hybrid" detergents formed with mixed surfactant systems including phenate and/or sulfonate components, e.g. phenate-salicylates, sulfonate-phenates, sulfonate-salicylates, and sulfonates-phenates-salicylates. Where, for example, a hybrid sulfonate/phenate detergent is employed, the hybrid detergent would be considered equivalent to amounts of distinct phenate and sulfonate detergents introducing like amounts of phenate and sulfonate soaps, respectively. Overbased phenates and salicylates typically have a total base number of 180 to 450 TBN. Overbased sulfonates typically have a total base number of 250 to 600, or 300 to 500.

Alkylphenols are often used as constituents in and/or building blocks for overbased detergents. Alkylphenols may be used to prepare phenate, salicylate, salixarate, or saligenin detergents or mixtures thereof. Suitable alkylphenols may include para-substituted hydrocarbyl phenols. The hydrocarbyl group may be linear or branched aliphatic groups of 1 to 60 carbon atoms, 8 to 40 carbon atoms, 10 to 24 carbon atoms, 12 to 20 carbon atoms, or 16 to 24 carbon atoms.

The overbased metal-containing detergent may be alkali metal or alkaline earth metal salts. In one embodiment, the overbased detergent may be sodium salts, calcium salts, magnesium salts, barium salts, lithium salts or mixtures thereof of the phenates, sulfur-containing phenates, sulfonates, salixarates, salicylates, naphthalenes, naphthenates, or oleates, or mixtures thereof. In one embodiment, the overbased detergent is a calcium detergent, a magnesium detergent or mixtures thereof. In one embodiment, both calcium and magnesium containing detergents may be present in the grease. Calcium and magnesium detergents may be present such that the weight ratio of calcium to magnesium is 10:1 to 1:10, or 8:3 to 4:5, or 1:1 to 1:3. In one embodiment, the overbased detergent is free of or substantially free of sodium.

In one embodiment, the sulfonate detergent may be predominantly a linear alkylbenzene sulfonate detergent having a metal ratio of at least 8. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent.

Salicylate detergents and overbased salicylate detergents may be prepared in at least two different manners. In a first manner, the detergent may be prepared via carbonylation (also referred to as carboxylation) of a p-alkylphenol followed by overbasing to form overbased salicylate detergent. Suitable p-alkylphenols include those with linear and/or branched hydrocarbyl groups of 1 to 60 carbon atoms. Salicylate detergents may also be prepared by alkylation of salicylic acid, followed by overbasing. Salicylate detergents prepared in this manner, may be prepared from linear and/or branched alkylating agents (usually 1-olefins) containing 6 to 50 carbon atoms, 10 to 30 carbon atoms, or 14 to 24 carbon atoms.

In some embodiments, the overbased metal detergent grease may have a total base number "TBN" of 150 to 700, to 200 to 600, to 300 to 500. The overbased metal detergent may be an overbased metal sulfonate, salicylate, naphthalene, naphthenate, phenate or oleate detergent, or mixtures thereof. In other embodiments, the overbased metal detergent may be present in a range of 15 to 75, or 20 to 60 weight percent based on a total yield of the grease.

In one embodiment, the grease may be a food-grade grease. Suitable greases may include, but are not limited to, greases comprising at least one base oil selected from highly refined mineral oils ("liquid paraffin" or "white oil"), polyalphaolefin, polyalkylene glycol, seed oil, vegetable oil ("esters"). In other embodiments, the grease may comprise an oil of lubricating viscosity selected from at least one API Group I, II, III, IV, or V oil, naphthenic oil, silicone oil, esters, or mixtures thereof.

Oils of Lubricating Viscosity

The greases described herein may also comprise an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO02008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO02008/147704 (a similar disclosure is provided in US Patent Application 2010/197536, see [0075] to [0076]). Synthetic oils may also be produced by Fischer-Tropsch reactions and typically may be hydroisomerized Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in the September 2011 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment, the oil of lubricating viscosity may be an API Group I oil.

Exemplary embodiments of grease formulations are shown in Table 1 below.

TABLE 1

| Ingredients | wt % A | wt % B | wt % C |
|---|---|---|---|
| $CaSO_4$ (may be a blend) | 15-75 | 20-60 | 25-55 |
| Promoter A | 0.1-3 | 0.1-2 | 0.1-1 |
| Methoxypolyethylene Glycol | | | |
| Promoter B | 0.1-3 | 0.1-2 | 0.1-1 |
| Sulfamic Acid | | | |
| SSA/DBBSA | 1-5 | 1-4 | 1-3 |
| Acetic Acid | 0.1-3 | 0.1-2 | 0.1-1 |
| Hexylene Glycol | 0.1-3 | 0.25-2.5 | 0.5-1.5 |
| Hydrated Lime | 0.5-5 | 1-4 | 1.5-3.5 |
| Boric Acid | 0.5-5 | 1-4 | 1.5-3.5 |
| 12-Hydroxystearic Acid | 1-10 | 2-7 | 2.5-5 |
| Anti-Oxidant | 0.1-2 | 0.1-1.5 | 0.1-1 |
| Diluent Oil* | Balance | Balance | Balance |
| | 100.00 | 100.00 | 100.00 |

*one or more API Group I to V oils, including paraffinic, naphthenic and/or synthetic oils The amount of each chemical component described (including the Grease Additives below) is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

The overbased metal detergent grease disclosed herein may have improved extreme pressure properties compared to a grease not comprising at least one of an acid, polyalkylene glycol, or mixtures thereof. Suitable methods for measuring improved extreme pressure properties include, but are not limited to, ASTM D2596, commonly called "4-ball weld point". Accordingly, in some embodiments, the grease may have an extreme pressure performance, as measured by the Standard Test Method for Measurement of Extreme-Pressure Properties of Lubricating Grease ("Four-Ball Method") ASTM D2596, of passing, or at least 620 kg-f. In yet another embodiment, the weld point using the Four-Ball Method of the grease may be at least 800 kg-f. In yet other embodiments, the overbased metal detergent grease disclosed herein may have anti-corrosion properties of copper of 1B or better using ASTM D4048. In other embodiments, the grease may have a wear test result of less than or equal to 0.60 mm using ASTM D2266.

Methods suitable for making the grease are not overly limited and include any method known to persons ordinarily skilled in the art. The grease may be made in a one-step process or a two-step process having a gelation step and a complexing step. If using a two-step process, the polyalkylene glycol and/or an acid having at least one of both a nitrogen and a sulfur atom may be used in the gelation step, the complexing step, or both. Both the polyalkylene glycol and/or an acid having at least one of both a nitrogen and a sulfur atom may be used together in a one-step process.

Upon visual observation, grease color can range from a white or off-white color to a dark brown color, depending on the ingredients used. While color does not in any way affect the performance of the grease, the market generally prefers lighter color greases having a white, off-white, tan, or beige color, and darker greases, such as brown grease are less preferred. The grease compositions disclosed herein have a preferable tan color.

The overbased metal detergent grease disclosed herein may be used to lubricate mechanical components. Accordingly, some embodiments include methods of lubricating a mechanical component using the overbased metal detergent grease described above. The methods may comprise contacting the mechanical component with the grease. Exemplary mechanical components include, but are not limited to, at least one of a gear, drivetrain element, bearing, hinge, or combinations thereof. In another embodiment, a method of improving the extreme pressure performance of an overbased metal sulfonate grease as measured by 4-ball weld point is disclosed.

Grease Additives

The grease composition optionally comprises other performance additives. The other performance additives include at least one of metal deactivators (often called corrosion inhibitors), rust inhibitors, viscosity modifiers, detergents, friction modifiers, antiwear agents, dispersants, dispersant viscosity modifiers, extreme pressure agents (in addition to the extreme pressure agents described above), antioxidants, and mixtures thereof. Typically, a fully-formulated grease composition will contain one or more of these performance additives.

The metal deactivators may comprise one or more derivatives of benzotriazole, benzimidazole, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles, 2-alkyldithio-5-mercaptothiadiazoles or mixtures thereof.

The benzotriazole compounds may include hydrocarbyl substitutions at one or more of the following ring positions 1- or 2- or 4- or 5- or 6- or 7-benzotriazoles. The hydrocarbyl groups may contain from 1 to 30 carbons, and in one embodiment from 1 to 15 carbons, and in one embodiment from 1 to 7 carbons. The metal deactivator may comprise 5-methylbenzotriazole. The metal deactivator may be present in the grease composition at a concentration in the range up to 5 wt %, or 0.0002 to 2 wt %, or 0.001 to 1 wt %.

The rust inhibitor may comprise one or more metal sulphonates such as calcium sulphonate or magnesium sulphonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, or half esters of alkenyl succinic acids in which the alkenyl group contains from 8 to 24 carbon atoms with alcohols such as polyglycols.

The rust inhibitors may present in the grease composition at a concentration in the range up to 4 wt %, and in one embodiment in the range from 0.02 wt % to 2 wt %, and in one embodiment in the range from 0.05 wt % to 1 wt %.

Antioxidants include diarylamine alkylated diarylamines, hindered phenols, dithiocarbamates, 1,2-dihydro-2,2,4-trimethylquinoline, hydroxyl thioethers, or mixtures thereof. In one embodiment the grease composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the grease composition.

The diarylamine alkylated diarylamine may be a phenyl-a-naphthylamine (PANA), an alkylated diphenylamine, or an alkylated phenylnapthylamine, or mixtures thereof. The alkylated diphenylamine may include di-nonylated diphenylamine, nonyl diphenyl amine, octyl diphenyl amine, di-octylated diphenylamine, or di-decylated diphenylamine. The alkylated diarylamine may include octyl, di-octyl, nonyl, di-nonyl, decyl or di-decyl phenylnapthylamines. In one embodiment the alkylated diphenylamine may comprise at least one of octylated diphenylamine, butylated diphenylamine, or mixtures thereof e.g. Irganox® L 57 from BASF.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. The bridging atom may be carbon or sulfur. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol.

In one embodiment the hindered phenol antioxidant may be an ester and may include, e.g., Irganox® L 135 from BASF. A more detailed description of suitable ester-containing hindered phenol antioxidant chemistry is found in U.S. Pat. No. 6,559,105.

The dithiocarbamate anti-oxidant may be metal containing such as molybdenum or zinc dithiocarbamate or it may be "ashless". Ashless refers to the dithiocarbamate as containing no metal and the linking group is typically a methylene group.

The 1,2-dihydro-2,2,4-trimethylquinoline may be present as a unique molecule or oligomerized with up to 5 repeat units and known commercially as "Resin D", available form a number of suppliers.

In one embodiment the grease composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

Some polymers may also be described as dispersant viscosity modifiers (often referred to as DVM) because they exhibit dispersant properties. Polymers of this type include olefins, for example, ethylene propylene copolymers that have been functionalized by reaction with maleic anhydride and an amine. Another type of polymer that may be used is polymethacrylate functionalized with an amine (this type may also be made by incorporating a nitrogen containing co-monomer in a methacrylate polymerization). More detailed description of dispersant viscosity modifiers are disclosed in International Publication WO 2006/015130 or U.S. Pat. Nos. 4,863,623; 6,107,257; 6,107,258; and 6,117,825. The viscosity modifiers may be present at 0 wt % to 15 wt %, or 0 wt % to 10 wt %, or 0.05 wt % to 5 wt %, or 0.2 wt % to 2 wt % of the grease composition.

The grease composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The dispersant may be an N-substituted long chain alkenyl succinimide. An example of an N-substituted long chain alkenyl succinimide is polyisobutylene succinimide. Typically, the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid.

Typically, the additional antiwear agent may be a phosphorus antiwear agent. The antiwear agent may be present at 0 wt % to 5 wt %, 0.001 wt % to 2 wt %, 0.1 wt % to 2.0 wt % of the lubricant. The phosphorus antiwear agent may include a phosphorus amine salt, calcium salt, or mixtures thereof. The phosphorus amine salt includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus—containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. In one embodiment the oil soluble phosphorus amine salt includes partial amine salt-partial metal salt compounds or mixtures thereof. In one embodiment the phosphorus compound further includes a sulphur atom in the molecule. In another embodiment the phosphorus compound is a derivative of calcium.

Additional examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

In one embodiment, the antiwear additives may include a zinc dialkyldithiophosphate. In other embodiments the grease is substantially free of, or even completely free of zinc dialkyldithiophosphate. In yet another embodiment, the grease includes a dithiocarbamate antiwear agent defined in U.S. Pat. No. 4,758,362 column 2, line 35 to column 6, line 11. When present the dithiocarbamate antiwear agent may be present from 0.25 wt %, 0.3 wt %, 0.4 wt % or even 0.5 wt % up to 3.0 wt %, 2.5 wt %, 2.0 wt % or even 0.55 wt % in the overall composition.

Grease additive packages may include the compositions in Table 2 below.

TABLE 2

| Grease Additive Package Compositions* | | |
|---|---|---|
| | Embodiments (wt %) | |
| Additive | Multi-functional | High Temp-Long Life |
| Overbased Metal Detergent (in addition to the detergent used to make the grease) | 20-30 | 0.1 to 5.0 |
| Antioxidant | 10 to 20 | 25.0 to 60.0 |
| Dispersant | 0.50 to 5.0 | — |
| Metal Deactivator | 1.0 to 8.0 | — |
| Antiwear Agent | — | 5.0 to 15.0 |
| Extreme Pressure Agent | 45.0 to 65.0 | 0.1 to 10.0 |
| Rust inhibitor | 1.0 to 5.0 | 30.0 to 40.0 |
| Diluent Oil | Balance to 100% | Balance to 100% |

*The grease additive package is treated at 2 wt % to 5 wt % of a grease composition.

In order to demonstrate improved performance in a grease composition, the composition may be evaluated versus control standards as to ASTM D2266-01 (2015): Standard Test Method for Wear Preventive Characteristics of Lubricating Grease (Four-Ball Method), ASTM D4170-10: Standard Test Method for Fretting Wear Protection by Lubricating Greases, ASTM D5969-11e: Standard Test Method for Corrosion-Preventive Properties of Lubricating Greases in Presence of Dilute Synthetic Sea Water Environments and ASTM D6138-13: Standard Test Method for Determination of Corrosion-Preventive Properties of Lubricating Greases Under Dynamic Wet Conditions (Emcor Test).

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Control ("Control")—Known Promotors

For the Control, 418 grams of overbased calcium sulfonate, 444 grams of 600 SUS viscosity oil ("Formulated Oil"), 24.2 grams of detergent dodecyl benzene sulfonic acid, 5.5 grams of acetic acid and 9.9 grams of hexylene glycol are added to a reactor. The mixture is mixed and heated to 85 to 90° C. and held at temperature for one hour. Complete conversion of amorphous calcium carbonate to calcite is verified by infrared. Once conversion is complete, 17.0 grams of hydrated lime in 50 grams of water and 25.2 grams of boric acid in 50 grams of water are added. The mixture is then heated and mixed slowly to 145° C. until all volatiles are stripped off. Then, 34.2 grams of 12-hydroxystearic acid is added and mixed while holding the temperature to 140 to 145° C. until all the 12-hydroxystearic acid is complexed. The mixture is then cooled to 90 to 95° C. followed by the addition of 5.0 grams of an antioxidant. The mixture is then cooled and adjusted to Grade 2 with 600 SUS oil and milled to prepare the finished grease.

Comparative Example 1 ("Comp 1")—Promotor B Only

For Comp 1, 418 grams of overbased calcium sulfonate, 444 grams of 600 SUS viscosity oil ("Formulated Oil"), 4.0 grams of sulfamic acid ("Promotor B"), 24.2 grams of detergent dodecyl benzene sulfonic acid, 5.5 grams of acetic acid and 9.9 grams of hexylene glycol are added to a reactor. The mixture is mixed and heated to 85 to 90° C. and held at temperature for one hour. Complete conversion of amorphous calcium carbonate to calcite is verified by infrared. Once conversion is complete, 30.2 grams of hydrated lime in 50 grams of water, 25.2 grams of boric acid in 50 grams of water are added. The mixture is then heated and mixed slowly to 145° C. until all volatiles are stripped off. Then, 34.2 grams of 12-hydroxystearic acid is added and mixed while holding the temperature to 140 to 145° C. until all the 12-hydroxystearic acid is complexed. The mixture is then cooled to 90 to 95° C. followed by the addition of 5.0 grams of an antioxidant. The mixture is then cooled and adjusted to Grade 2 with 600 SUS oil and milled to prepare the finished grease.

Inventive Example 1 ("EX 1")—Promotor A Only

First, 418 grams of overbased calcium sulfonate, 444 grams of 600 SUS viscosity oil ("Formulated Oil"), 3.0 grams of methoxypolyethylene glycol ("Promotor A"), 8.6 grams of detergent dodecyl benzene sulfonic acid, 13.0 grams of acetic acid and 14.0 grams of hexylene glycol are added to a reactor. The mixture is mixed and heated to 85 to 90° C. and held at temperature for one hour. Complete conversion of amorphous calcium carbonate to calcite is verified by infrared. Once conversion is complete, 17.0 grams of hydrated lime in 50 grams of water, 25.2 grams of boric acid in 50 grams of water, 3.0 grams of methoxypolyethylene glycol ("Promotor A") are added. The mixture is then heated and mixed slowly to 145° C. until all volatiles are stripped off. Then, 34.2 grams of 12-hydroxystearic acid is added and mixed while holding the temperature to 140 to 145° C. until all the 12-hydroxystearic acid is complexed. The mixture is then cooled to 90 to 95° C. followed by the addition of 5.0 grams of an antioxidant. The mixture is then cooled and adjusted to Grade 2 with 600 SUS oil and milled to prepare the finished grease.

Inventive Example 2 ("EX 2")—Promotor A and Promotor B

For EX 2, 418 grams of overbased calcium sulfonate, 444 grams of 600 SUS viscosity oil ("Formulated Oil"), 3.0 grams of methoxypolyethylene glycol ("Promotor A"), 8.6 grams of detergent dodecyl benzene sulfonic acid, 7.5 grams of acetic acid, and 14.0 grams of hexylene glycol are added to a reactor. The mixture is mixed and heated to 85 to 90° C. and held at temperature for one hour. Complete conversion of amorphous calcium carbonate to calcite is verified by infrared. Once conversion is complete, 17.0 grams of hydrated lime in 50 grams of water, 25.2 grams of boric acid in 50 grams of water are added. To this mixture, 4.0 grams of sulfamic acid ("Promotor B") and another 3.0 grams of methoxypolyethylene glycol ("Promotor A") are added. The mixture is then heated and mixed slowly to 145° C. until all volatiles are stripped off. Then, 34.2 grams of 12-hydroxystearic acid is added and mixed while holding the temperature to 140 to 145° C. until all the 12-hydroxystearic acid is complexed. The mixture is then cooled to 90 to 95° C. followed by the addition of 5.0 grams of an antioxidant. The mixture is then cooled and adjusted to Grade 2 with 600 SUS oil and milled to prepare the finished grease.

Inventive Example 3("EX 3")—Promotor A and Promotor B

EX 3 is similar to EX2, except different amounts of hexylene glycol and hydrated lime are used in the complexing step. First, 418 grams of overbased calcium sulfonate, 444 grams of 600 SUS viscosity oil ("Formulated Oil"), 3.0 grams of methoxypolyethylene glycol ("Promotor A"), 8.6 grams of detergent dodecyl benzene sulfonic acid, 7.5 grams of acetic acid and 9.9 grams of hexylene glycol are added to a reactor. The mixture is mixed and heated to 85 to 90° C. and held at temperature for one hour. Complete conversion of amorphous calcium carbonate to calcite is verified by infrared. Once conversion is complete, 21.0 grams of hydrated lime in 50 grams of water and 25.2 grams of boric acid in 50 grams of water are added. To this mixture, 4.0 grams of sulfamic acid ("Promotor B") and another 3.0 grams of methoxypolyethylene glycol ("Promotor A") are added. The mixture is then heated and mixed slowly to 145° C. until all volatiles are stripped off. Then, 34.2 grams of 12-hydroxystearic acid is added and mixed while holding the temperature to 140 to 145° C. until all the 12-hydroxystearic acid is complexed. The mixture is then cooled to 90 to 95° C. followed by the addition of 5.0 grams of an antioxidant. The mixture is then cooled and adjusted to Grade 2 with 600 SUS oil and milled to prepare the finished grease.

Inventive Example 4("EX 4")—Promotor A and Promotor B

EX 4 is similar to EX3, except different amounts of acetic acid and hydrated lime are used in the complexing step. First, 418 grams of overbased calcium sulfonate, 444 grams of 600 SUS viscosity oil ("Formulated Oil"), 3.0 grams of methoxypolyethylene glycol ("Promotor A"), 8.6 grams of detergent dodecyl benzene sulfonic acid, 5.5 grams of acetic acid and 9.9 grams of hexylene glycol are added to a reactor. The mixture is mixed and heated to 85 to 90° C. and held at temperature for one hour. Complete conversion of amorphous calcium carbonate to calcite is verified by infrared. Once conversion is complete, 17.0 grams of hydrated lime in 50 grams of water and 25.2 grams of boric acid in 50 grams of water are added. To this mixture, 4.0 grams of sulfamic acid ("Promotor B") and another 3.0 grams of methoxypolyethylene glycol ("Promotor A") are added. The mixture is then heated and mixed slowly to 145° C. until all volatiles are stripped off. Then, 34.2 grams of 12-hydroxystearic acid is added and mixed while holding the temperature to 140 to 145° C. until all the 12-hydroxystearic acid is complexed. The mixture is then cooled to 90 to 95° C. followed by the addition of 5.0 grams of an antioxidant. The mixture is then cooled and adjusted to Grade 2 and milled to prepare the finished grease.

The above examples were checked for 4-ball extreme pressure ("EP") ASTM D2596 and wear ASTM D2266. The results are shown in Table 3 below.

TABLE 3

| Grease Component (wt %) | Control | Comp 1 promotor B alone | Ex 1 Promotor A alone | EX 2 Pro A + Pro B | EX 3 Pro A + Pro B | EX 4 Pro A + Pro B |
|---|---|---|---|---|---|---|
| % 400 TBN overbased Ca-sulfonate detergent | 41.8 | 41.8 | 41.8 | 41.8 | 41.8 | 41.8 |
| % Promoter A (MPEG-550) | 0 | 0 | 0.6 | 0.6 | 0.6 | 0.6 |
| % Promoter-B (sulfamic acid) | 0 | 0.4 | 0 | 0.4 | 0.4 | 0.4 |
| % Acetic acid(ACOH) | 0.55 | 0.55 | 1.3 | 0.75 | 0.75 | 0.55 |
| % Hexylene Glycol(HG) | 0.99 | 0.99 | 1.4 | 1.4 | 0.99 | 0.99 |
| % Dodecyl benzene sulfonic acid(DDBSA) | 2.42 | 2.4 | 0.86 | 0.86 | 0.86 | 0.86 |
| % Hydrated Lime(Lime) | 1.7 | 3.02 | 1.7 | 1.7 | 2.1 | 1.7 |
| % Remaining Components[1] | 6.43 | 6.43 | 6.43 | 6.43 | 6.43 | 6.43 |
| % Formulated Oil[2] | balance | balance | balance | balance | balance | balance |
| Total Yield (wt %) | 100 | 100 | 100 | 100 | 100 | 100 |
| Performance Test | | | | | | |
| ASTM D2596 4-BALL EP, kg-f | 500 | 500 | 800 | 800 | 800 | 800 |
| ASTM D2266 4 BALL WEAR, mm | 0.473 | — | 0.51 | 0.471 | 0.467 | 0.511 |
| Color, Observed Visually | Tan | Tan | Tan | Tan | Tan | Tan |

[1]see example write-ups in paragraphs [0066]-[0068] above.
[2]600 SUS oil was added to get a total theoretical yield of 100.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

The invention claimed is:

1. An overbased metal detergent grease comprising at least one acid having at least one of both a nitrogen and a sulfur atom.

2. An overbased metal detergent grease comprising at least one polyalkylene glycol that is methoxypolyethylene glycol having a number average ($M_n$) molecular weight of 190 to 9000.

3. The grease of claim 2, wherein the methoxypolyethylene glycol has a number average molecular weight of 350 to 750 $M_n$.

4. The grease of claim 2, wherein the polyalkylene glycol is present in a range of 0.1 to 3 weight percent based on a total yield of the grease.

5. The grease of claim 1, wherein the acid is present in a range of 0.1 to 3 weight percent based on a total yield of the grease.

6. The grease of claim 1, wherein the acid comprises at least one of sulfamic acid, 2-acrylamido 2-methyl propane sulfonic acid, or combinations thereof.

7. The grease of claim 1, wherein the grease comprises an adduct of said acid and a polyalkylene glycol.

8. The grease of claim 7, wherein the weight ratio of said acid to polyalkylene glycol ranges from 4:1 to 1:4.

9. The grease of claim 7, wherein said adduct is the adduct of sulfamic acid and methoxypolyethylene glycol.

10. The grease of claim 1 or 2, wherein the overbased metal detergent has a total base number of TBN of 150 to 700.

11. The grease of claim 10, wherein the overbased metal detergent is an overbased metal sulfonate, salicylate, naphthalene, naphthenate, phenate or oleate detergent, or mixtures thereof.

12. The grease of claim 10, wherein the overbased metal detergent is present in a range of 15 to 75 weight percent based on a total yield of the grease.

13. The grease of claim 1 or 2, wherein the grease comprises at least one base oil selected from highly refined mineral oils, polyalphaolefin, polyalkylene glycol, seed oil, vegetable oil, or mixtures thereof.

14. The grease of claim 1 or 2, wherein the grease comprises an oil of lubricating viscosity selected from at least one API Group I, II, III, IV, or V oil, naphthenic oil, silicone oil, esters, or mixtures thereof.

15. The grease of claim 1 or 2, wherein the grease has an extreme pressure performance, as measured by the Standard Test Method for Measurement of Extreme-Pressure Properties of Lubricating Grease ("Four-Ball Method") ASTM D2596, of passing, or at least 620 kg-f.

16. The grease of claim 1 or 2, wherein the grease has a copper corrosion value as measured using ASTM D4048 of 1B or better.

17. The grease of claim 1 or 2, wherein the grease has a wear test result of less than or equal to 0.60 mm using ASTM D2266.

18. A method of lubricating a mechanical component using the grease of claim 1 or 2, said method comprising contacting said mechanical component with said grease.

19. The method of claim 18, wherein the mechanical component is at least one of a gear, drivetrain element, bearing, hinge, or combinations thereof.

* * * * *